US010900338B2

(12) United States Patent
Tunkiel et al.

(10) Patent No.: US 10,900,338 B2
(45) Date of Patent: Jan. 26, 2021

(54) SYSTEM AND METHOD FOR DISPERSING FLUID FLOW FROM HIGH SPEED JET

(71) Applicant: Schlumberger Technology Corporation, Sugar Land, TX (US)

(72) Inventors: Andrzej Tunkiel, Algard (NO); Kevin Beranger, Algard (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 555 days.

(21) Appl. No.: 14/925,614

(22) Filed: Oct. 28, 2015

(65) Prior Publication Data

US 2016/0123125 A1 May 5, 2016

Related U.S. Application Data

(60) Provisional application No. 62/072,249, filed on Oct. 29, 2014.

(51) Int. Cl.
*E21B 43/25* (2006.01)
*E21B 41/00* (2006.01)

(52) U.S. Cl.
CPC ..... *E21B 43/25* (2013.01); *E21B 41/0078* (2013.01)

(58) Field of Classification Search
CPC ..... E21B 43/25; E21B 43/12; F16K 31/53
See application file for complete search history.

(56) References Cited

U.S. PATENT DOCUMENTS

| | | | | |
|---|---|---|---|---|
| 4,004,615 | A * | 1/1977 | Stern | B04C 5/085 138/178 |
| 4,621,953 | A * | 11/1986 | McGuth | F16L 57/06 138/39 |
| 5,010,910 | A * | 4/1991 | Hickey | E21B 36/00 137/1 |
| 5,924,490 | A | 7/1999 | Stone | |
| 7,419,002 | B2 | 9/2008 | Dybevik | |
| 2006/0048942 | A1* | 3/2006 | Moen | E21B 43/12 166/306 |
| 2008/0094936 | A1* | 4/2008 | Corti | B29B 7/7668 366/162.4 |

(Continued)

OTHER PUBLICATIONS

Ellis, T. et al., "Inflow Control Devices—Raising Profiles", Oilfield Review, 2009/2010, 21(4), 8 pages.

(Continued)

*Primary Examiner* — William D Hutton, Jr.
*Assistant Examiner* — Avi R Skaist
(74) *Attorney, Agent, or Firm* — Kelly McKinney

(57) ABSTRACT

A technique facilitates dispersion of injected fluid flow. A well string may be constructed with a screen assembly having a base pipe with a radial port, a filter medium, and a housing positioned along an exterior of the base pipe. The housing is constructed and positioned to form a chamber which receives high-pressure fluid exiting from an interior of the base pipe through the base pipe port. In some applications, a separate nozzle may be mounted in cooperation with the base pipe port. The screen assembly further comprises a dispersion member having features positioned in a flow path of the injected fluid to disperse the flow and thus to reduce the erosive effects.

22 Claims, 5 Drawing Sheets

(56) References Cited

U.S. PATENT DOCUMENTS

| | | | | |
|---|---|---|---|---|
| 2008/0251255 | A1* | 10/2008 | Forbes | E21B 43/2406 166/305.1 |
| 2010/0108309 | A1 | 5/2010 | Sunyovszky et al. | |
| 2011/0147007 | A1* | 6/2011 | O'Malley | E21B 23/004 166/373 |
| 2011/0247813 | A1* | 10/2011 | Moen | E21B 43/088 166/278 |
| 2012/0298356 | A1 | 11/2012 | Sladic et al. | |

OTHER PUBLICATIONS

Search Report and Written Opinion of International Application No. PCT/US2015/057960 dated Jan. 7, 2016, 13 pages.

* cited by examiner

SYSTEM AND METHOD FOR DISPERSING FLUID FLOW FROM HIGH SPEED JET

CROSS-REFERENCE TO RELATED APPLICATIONS

The present document is based on and claims priority to U.S. Provisional Application Ser. No.: 62/072,249 filed Oct. 29, 2014, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. In some applications, injection wells are formed so that high-pressure fluid may be injected into the hydrocarbon-bearing formation to promote oil production in other well zones or in adjacent wells. A completion string may be deployed in the injection well, and an injection portion of the completion string uses nozzles to equalize injection along the well. However, injecting through nozzles creates undesirable high velocity fluid jets which can have substantial erosive effects.

SUMMARY

In general, a system and methodology are provided for dispersing a flow of injected fluid. A well string may be constructed with a screen assembly having a base pipe with a radial port, a filter medium, and a housing positioned along an exterior of the base pipe. The housing is constructed and positioned to form a chamber which receives high-velocity fluid exiting from an interior of the base pipe through the base pipe port. In some applications, a separate nozzle may be mounted in cooperation with the base pipe port. The screen assembly further comprises a dispersion member having features positioned in a flow path of the injected fluid to disperse the flow and thus to reduce the erosive effects.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for dispersing a flow of injected fluid, e.g. for dispersing fluid flow from a high speed jet. The technique may be employed in a variety of applications in which a high speed jet of fluid, e.g. liquid, is dispersed to reduce or eliminate erosive effects. For example, the technique is useful in a number of well applications, including injection applications in which an injection fluid is delivered downhole and injected into a surrounding formation. In a well related embodiment, a well string may be constructed with a screen assembly having a base pipe with a radial port, a filter medium, and a housing positioned along an exterior of the base pipe. The housing is constructed and positioned to form a chamber which receives high-pressure fluid exiting from an interior of the base pipe through the base pipe port. In some applications, a separate nozzle may be mounted in cooperation with the base pipe port.

The screen assembly further comprises a dispersion member having features positioned in a flow path of the injected fluid to disperse the flow and thus to reduce the erosive effects. By way of example, the dispersion member may comprise at least one tooth extending into the chamber, e.g. a plurality of teeth which extend into the chamber. The teeth are positioned in the flow path to disperse the flow and to reduce the erosive effects.

In some well applications, water is used as an injection fluid. The water is pumped downhole through a tubing string under high pressure and injected into a surrounding reservoir to promote well production in other well zones and/or other wells. In this type of embodiment, the water may be injected through a plurality of nozzles deployed along the tubing string to equalize injection along the well. In some applications, the injected fluid, e.g. water, flows outwardly through screen assemblies after passing through nozzles placed in cooperation with corresponding radial ports extending through an internal base pipe. The fluid flow exiting the nozzles is directed through corresponding dispersion members which disperse the fluid flow, thus reducing the erosive effects of the fluid flow. The erosive effects are reduced by reducing flow velocity as a result of the size of the jet being effectively increased.

Figure 1:
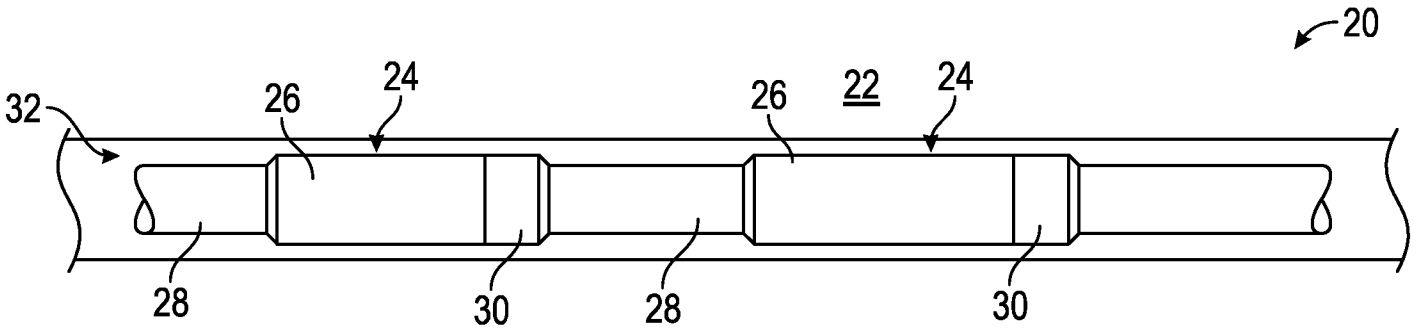
FIG. 1 is a schematic illustration of an example of a well system deployed in a wellbore and comprising at least one screen assembly, according to an embodiment of the disclosure.

Referring generally to FIG. 1, an embodiment of a tubing string, e.g. well completion system 20, is illustrated and may be used for injecting fluid, e.g. water or other suitable liquids, into a surrounding reservoir 22. The well completion system 20 may comprise at least one and often a plurality of screen assemblies 24. The screen assemblies 24 individually comprise a filter medium 26 disposed radially outward of a base pipe 28. For example, the filter medium 26 may be in the form of a screen or mesh surrounding the base pipe 28. In this example, each illustrated screen assembly 24 also comprises a housing 30 positioned along an exterior of the base pipe 28.

Although the present technique may be used with a variety of injection systems, the illustrated well completion system 20 provides an example of a well application in which the system 20 is disposed in a wellbore 32 of a well. In some applications, a gravel pack may be formed around the screen assemblies 24 to further filter particulates from inflowing fluid during subsequent production operations. The well completion system 20 may be located in a deviated wellbore 32, e.g. a horizontal wellbore, located in the reservoir 22. Additionally, the well completion system 20 may be used for injection operations or combined injection and production operations.

Figure 2:
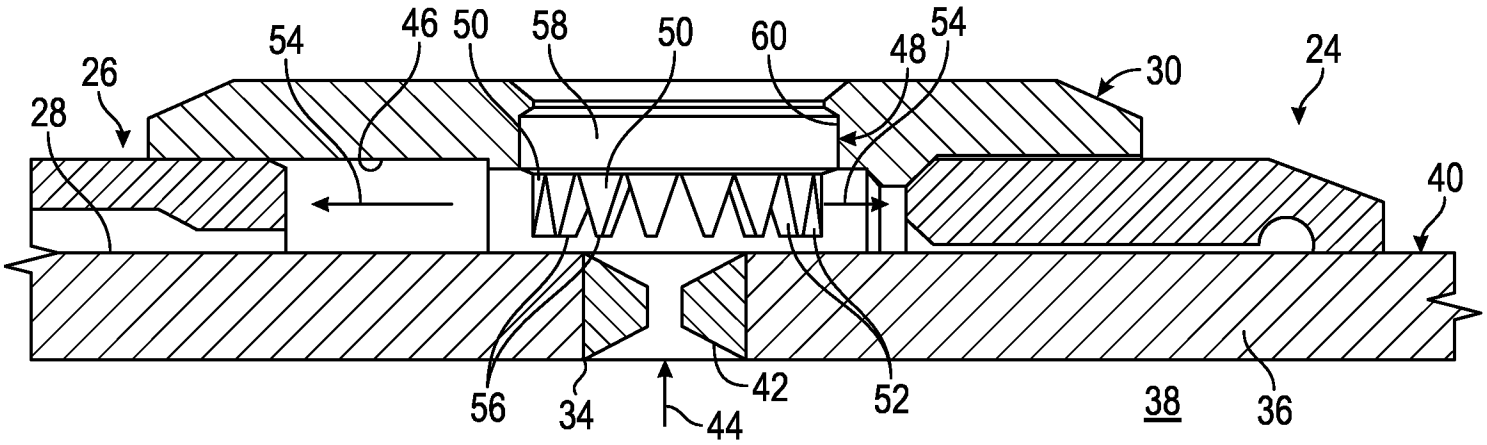
FIG. 2 is a cross-sectional view of an example of a housing assembly having a dispersion member, the housing assembly being of the type that may be used with a screen assembly, according to an embodiment of the disclosure.

Referring generally to FIG. 2, the housing 30 of one of the screen assemblies 24 is illustrated in cross-section. In this example, base pipe 28 includes at least one lateral/radial port 34 in the sense that radial port 34 extends through a wall 36 of base pipe 28 between an interior 38 of the base pipe and an exterior 40 of the base pipe 28. Interior 38 provides a delivery flow passage for injection fluid as it flows through the well completion system 20 to port 34. The port 34 may serve as an injection nozzle; or a separate nozzle 42 may be placed in cooperation with the port 34 to receive a flow of injection fluid therethrough, as represented by arrow 44. In the embodiment illustrated in FIG. 2, the nozzle 42 is positioned in port 34, e.g. threadably engaged with port 34, but the nozzle 42 may be located at other positions in cooperation with port 34.

Referring again to FIG. 2, the housing 30 is positioned along exterior 40 of base pipe 28 and creates a chamber 46 for receiving a fluid injected through the nozzle 42 from the interior 38 of base pipe 28. A dispersion member 48 is constructed with features positioned to extend into the chamber 46 to disperse the flow of fluid exiting base pipe port 34 and nozzle 42. In the example illustrated, the dispersion member 48 comprises dispersion features in the form of at least one tooth 50, e.g. a plurality of teeth 50 separated by spaces 52. The dispersion member 48 is positioned such that the teeth 50 extend into a flow path of the injected fluid at a position downstream of the nozzle 42/port 34 to disperse the flow as indicated by arrows 54. Dispersion of the flow of injection fluid reduces the erosive effects of the fluid on surrounding components such as components of the screen assembly 24.

Figure 3:
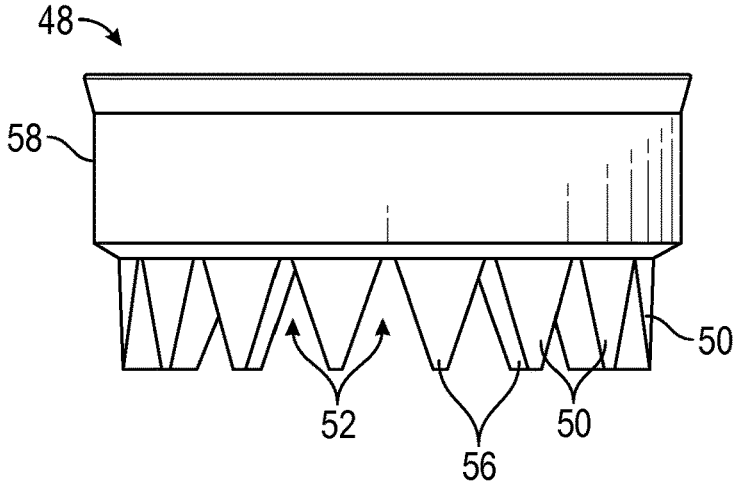
FIG. 3 is a side view of the example of a dispersion member illustrated in FIG. 2, according to an embodiment of the disclosure.
Figure 4:
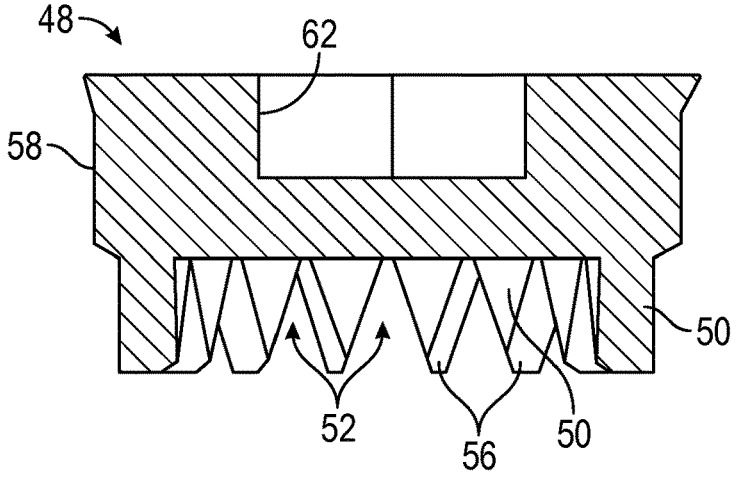
FIG. 4 is a cross-sectional view of the dispersion member illustrated in FIG. 3, according to an embodiment of the disclosure.

With additional reference to FIGS. 3 and 4, teeth 50 may be generally triangular in shape and separated by triangularly shaped spaces 52. The triangular shape has been determined to be particularly useful in dispersing fluid flow from high speed jets in a variety of applications. In the example illustrated, the teeth 50 are oriented such that tips 56 of the triangular teeth 50 are positioned toward base pipe 28. In other words, the plurality of teeth 50 extend inwardly toward the base pipe 28, and the flow of injection fluid 44 is forced by dispersion member 48 to move longitudinally through the spaces 52 between teeth 50 as the fluid flows through chamber 46. In this example, the chamber 46 is shaped to direct the flow of fluid exiting dispersion member 48 toward an interior of the filter medium 26 so that the fluid can flow outwardly through the filter medium 26 and into the surrounding reservoir/formation 22.

In some applications, the dispersion member 48 and its teeth 50 may be integrally formed with housing 30. In other applications, however, the dispersion member 48 may be a separate component having, for example, a mounting structure 58 from which teeth 50 extend. In the example illustrated in FIGS. 2-4, the mounting structure 58 is in the form of a plug sized and configured for receipt in a corresponding opening 60 of housing 30. The mounting structure 58 may be threadably engaged with housing 30 or otherwise releasably coupled with the housing 30. In this embodiment, the opening 60 and the mounting structure 58 are oriented such that teeth 50 extend inwardly toward base pipe 28 and surround or encircle the base pipe port 34 and nozzle 42. The dispersion member 48 also may comprise tool receipt features 62, e.g. wrench attachment features, to facilitate use of a suitable tool in releasably attaching dispersion member 48 to housing 30.

Figure 5:
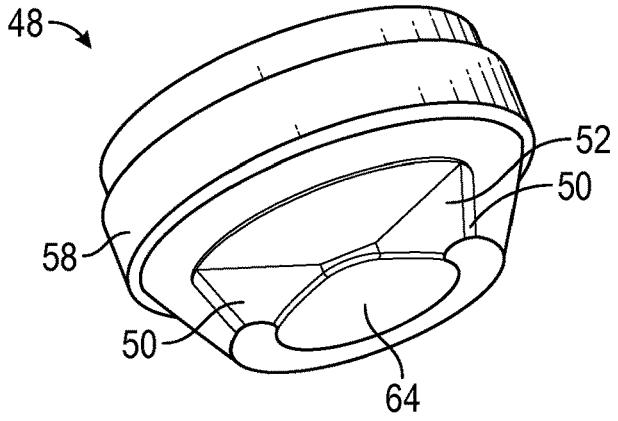
FIG. 5 is an illustration of another example of the dispersion member, according to an embodiment of the disclosure.

Referring generally to FIG. 5, another embodiment of dispersion member 48 is illustrated. In this example, the dispersion member 48 comprises teeth 50 arranged to provide space or spaces 52 which are directional. In some applications, the dispersion member 48 may again be in the form of a plug having a generally circular mounting structure 58 with the directional teeth 50 extending from the mounting structure 58. A hemispherical recess 64, or other suitably shaped recess 64, may be used to guide the flow of injection fluid from nozzle 42 and into the directional space or spaces 52. This ensures the fluid flow is dispersed in a desired direction or directions.

Figure 6:
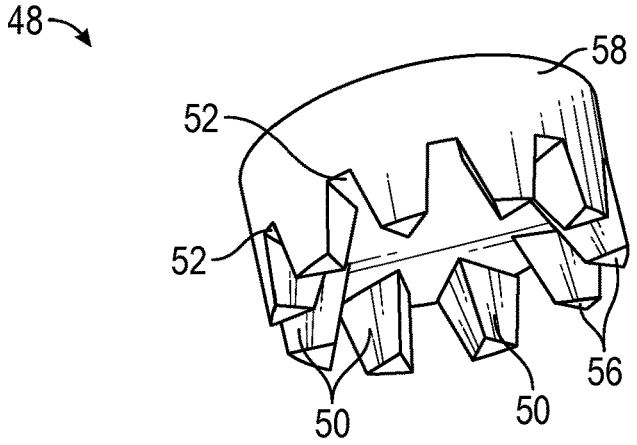
FIG. 6 is an illustration of another example of the dispersion member, according to an embodiment of the disclosure.
Figure 7:
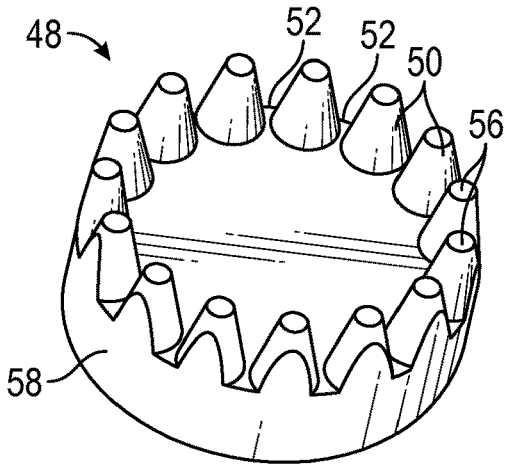
FIG. 7 is an illustration of another example of the dispersion member, according to an embodiment of the disclosure.

In FIG. 6, another embodiment of dispersion member 48 is illustrated. In this example, the teeth 50 are again separated by spaces 52, but the teeth 50 have generally flat tips 56. In the illustrated example, the teeth 50 are generally trapezoidal in shape and have a generally parallel base and tip coupled by divergent sides. In some applications, the plurality of teeth 50 may be arranged in a generally circular or otherwise curved pattern similar to the pattern illustrated in the embodiment of FIGS. 2-4. The curved or circular pattern effectively locates the teeth 50 so as to surround or encircle the base pipe port 34 and nozzle 42 when the dispersion member 48 is coupled with housing 30. In other embodiments, the teeth may be generally circular in cross-section and/or have curved tips 56, as illustrated in FIG. 7.

Figure 8:
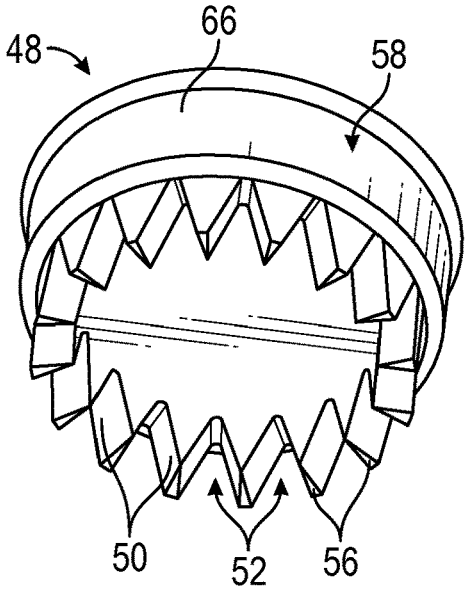
FIG. 8 is an illustration of another example of the dispersion member, according to an embodiment of the disclosure.
Figure 9:
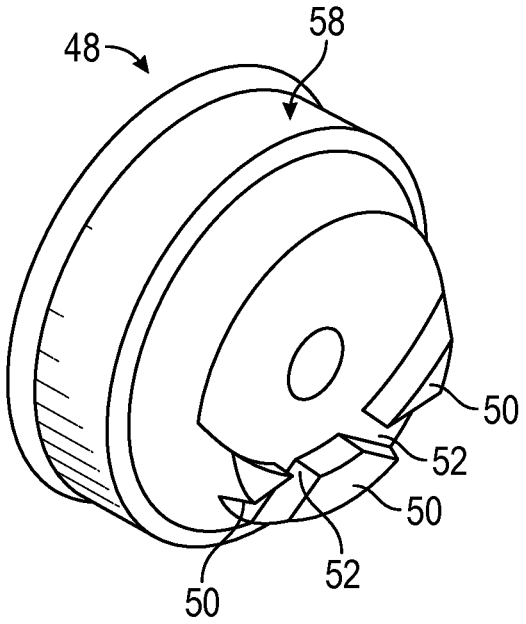
FIG. 9 is an illustration of another example of the dispersion member, according to an embodiment of the disclosure.

In FIG. 8, an embodiment similar to the embodiment of FIGS. 3 and 4 is illustrated in which the teeth 50 extend from mounting structure 58 to create spaces 52 through which the injection fluid flow is dispersed. In this example, the mounting structure 58 comprises a threaded region 66 which allows the dispersion member 48 to be threadably and releasably engaged with housing 30. Threaded region 66 also may be used in other embodiments of dispersion member 48. The teeth 50 may be triangular, trapezoidal, rounded, and/or another suitable shape to provide the desired non-directional dispersion of flow downstream of nozzle 42. However, various arrangements of teeth 50 also may be employed to create spaces 52 of different sizes and specific orientations to provide desired directional flow patterns of dispersed injection fluid. Another example of such a directional dispersion member 48 having spaces 52 of differing sizes is illustrated in FIG. 9. In such a directional embodiment, the teeth 50 may be similarly mounted to mounting structure 58 or directly to housing 30 as described above with respect to the non-directional embodiments.

Figure 10:
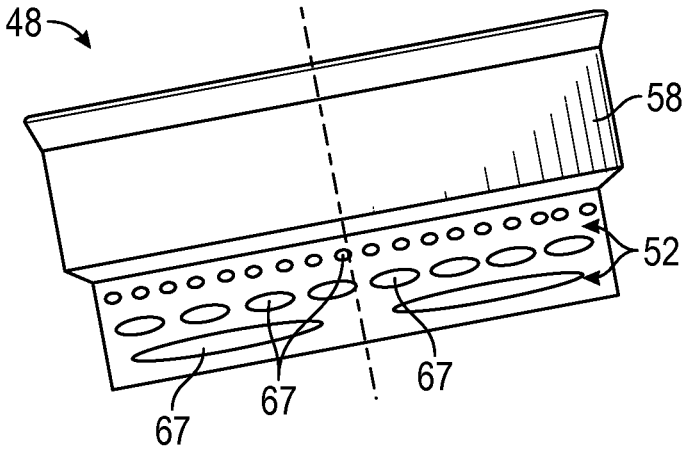
FIG. 10 is an illustration of another example of the dispersion member, according to an embodiment of the disclosure.

Referring generally to FIG. 10, another example of dispersion member 48 is illustrated. In this example the spaces 52 are in the form of an opening or openings 67. By way of example, opening 67 may be in the form of a slot or slots extending through a portion of mounting structure 58 and/or through a portion of dispersion member 48 coupled with mounting structure 58. The openings 67 also may be in the form of perforations having a common size or different sizes. By way of example, the openings/perforations 67 may be formed in a cylinder or porous material formed as part of or coupled with mounting structure 58. By forming the opening 67 in the material of mounting structure 58 or in the material extending from mounting structure 58, the fluid flow is spread similarly to that described above with reference to embodiments utilizing teeth 50 separated by spaces 52.

Figure 11:
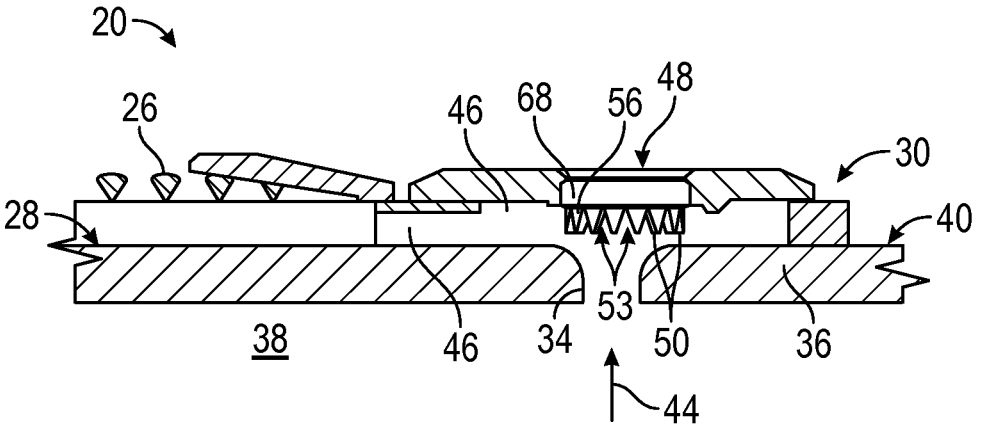
FIG. 11 is an illustration of another example of the dispersion member positioned in a screen assembly, according to an embodiment of the disclosure.

Depending on the application, the dispersion member 48 may have other forms. As illustrated in the embodiment of FIG. 11, for example, the dispersion member 48 comprises a ring 68 which may be disposed circumferentially around the entire base pipe 28 or a portion of base pipe 28 within housing 30. The teeth 50 may be oriented in a variety of directions to disperse the injection fluid flowing from interior 38, through flow port 34, and into a chamber 46. In FIG. 11, the teeth 50 are oriented to extend towards base pipe 28 such that the tips 56 of teeth 50 are closest to the base pipe 28. In this example, the flow port 34 may serve as a nozzle or a separate nozzle member 42 may be positioned in cooperation with flow port 34. Regardless, the dispersion member 48 is positioned such that the injection fluid flows through the dispersion member and is dispersed by teeth 50.

Figure 12:
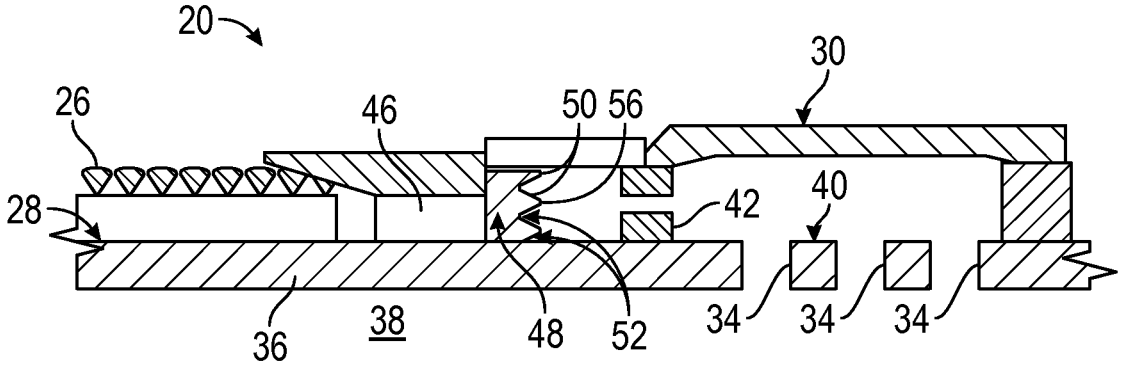
FIG. 12 is an illustration of another example of the dispersion member positioned in a screen assembly, according to an embodiment of the disclosure.
Figure 13:
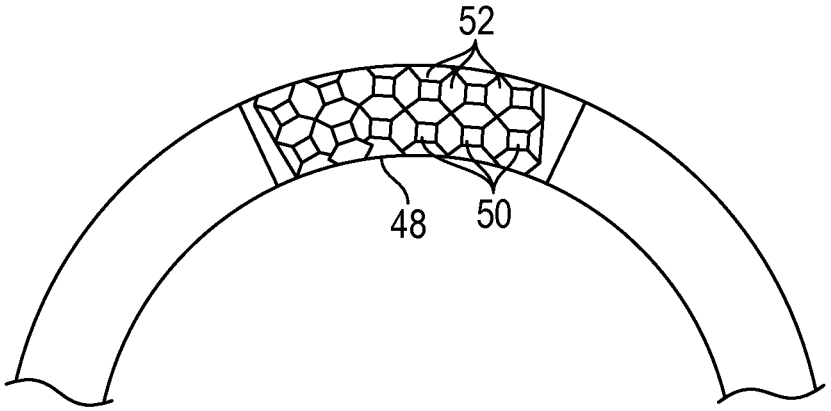
FIG. 13 is a view of the dispersion member illustrated in FIG. 12 taken from an axial or longitudinal perspective, according to an embodiment of the disclosure.

In some embodiments, the plurality of teeth 50 may be oriented in other directions, including directions which are generally parallel with the base pipe 28, i.e. parallel with an axis of the base pipe 28. Referring generally to FIG. 12, an example is illustrated in which the teeth 50 extend in a direction generally parallel with the base pipe 28 and parallel with the direction of fluid flow passing through nozzle 42. In this embodiment, nozzle 42 is positioned to cooperate with at least one, e.g. a plurality, of flow ports 34 extending through wall 36 of base pipe 28. However, the nozzle 42 is separate from the port or ports 34 as illustrated. The teeth 50 may be arranged in a variety of patterns to provide the desired dispersal of injection fluid flow. As illustrated in FIG. 13, for example, the teeth 50 may be arranged in curved rows which redirect the high-pressure flow of injection fluid in a plurality of directions, thus dispersing the injection fluid flow to reduce erosive effects.

It should be noted that many of the assemblies described herein may be formed as unified structures or by separate components joined together. For example, ring 68 may be formed as a unified portion of housing 30. Similarly, the overall dispersion member 48 may be a unified feature of housing 30. Depending on the application, other components also may be formed as portions of a unified structure or they may be constructed as separate components which are combined and joined together.

Many types of dispersion members 48 may be employed in various systems 20, including well systems and other types of systems which utilize a high-pressure flow of injected fluid. In well applications, the dispersion member or members 48 may be combined with many types of screen assemblies or other assemblies through which fluid travels under relatively high rates and pressures. Numerous types of metals, composites, and other materials may be used to construct the dispersion member. Similarly, the dispersion member may have various configurations in which teeth of desired shapes are positioned to create desired spaces. The teeth and spaces may be arranged in specific patterns to provide a desired dispersal of the fluid flow. When combined with screen assemblies, the injection fluid flow may be directed through individual flow ports or a plurality of flow ports. Additionally, the flow ports may be constructed as nozzles or with appropriate inserts which serve as nozzles. Separate nozzles also may be used in cooperation with the flow ports to appropriately route the flow of injection fluid.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for injecting fluid in a well, comprising:

a well string having an assembly, the assembly comprising:

a base pipe comprising: an interior; an exterior; and a wall extending between the interior and the exterior;

a nozzle positioned within a radial port extending through the wall of the base pipe;

a housing positioned along the exterior of the base pipe, the housing creating a chamber for receiving a fluid injected through the nozzle from the interior of the base pipe; and a dispersion member extending into the chamber downstream of the nozzle, the dispersion member having a plurality of teeth separated by spaces, the plurality of teeth positioned in a flow path of the fluid to disperse the flow and thus reduce erosive effects, wherein the fluid is forced by the dispersion member to move longitudinally through the spaces between the plurality of teeth as the fluid flows through the chamber.

2. The system as recited in claim 1, wherein the dispersion member comprises a plug mounted to the housing such that the plurality of teeth extend inwardly toward the base pipe.

3. The system as recited in claim 1, wherein the dispersion member comprises a ring positioned within the housing such that the plurality of teeth extend inwardly toward the base pipe.

4. The system as recited in claim 1, wherein the plurality of teeth extend generally parallel with respect to the base pipe and with respect to the flow through the nozzle.

5. The system as recited in claim 1, wherein the plurality of teeth comprises triangularly shaped teeth.

6. The system as recited in claim 1, wherein the plurality of teeth comprises teeth having curved tips.

7. The system as recited in claim 1, wherein the plurality of teeth comprises trapezoidally shaped teeth.

8. The system as recited in claim 1, wherein the chamber is shaped to direct the fluid to an interior of a filter medium after the fluid passes through the dispersion member, the filter medium being disposed about the base pipe.

9. The system as recited in claim 2, wherein the plug is removable from the housing.

10. A method, comprising:

providing a screen assembly with a base pipe, a filter medium about the base pipe, and a nozzle, wherein the base pipe comprises: an interior; an exterior; and a wall extending between the interior and the exterior;

positioning the nozzle within a radial port extending through the wall of the base pipe to receive a flow of injection fluid from an interior of the base pipe and to direct the flow into a chamber downstream of the nozzle during the flow of injection fluid;

locating a dispersion member comprising a plurality of features separated by spaces in the chamber; and forcing the flow of injection fluid to move longitudinally through the spaces of the dispersion member as the injection fluid moves through the chamber.

11. The method as recited in claim 10, wherein the plurality of features is a plurality of teeth oriented toward the base pipe.

12. The method as recited in claim 10, wherein locating the dispersion member comprises orienting the plurality of features by providing a plurality of teeth parallel with the base pipe.

13. The method as recited in claim 10, wherein the spaces comprise a plurality of openings to disperse the flow of injection fluid.

14. The method as recited in claim 10, wherein locating further comprises locating the dispersion member within a housing mounted to the base pipe over a base pipe port extending through a wall of the base pipe to enable the flow from an interior to an exterior of the base pipe.

15. The method as recited in claim 10, further comprising forming the dispersion member as a plug threadably engaged with a housing mounted along an exterior of the base pipe.

16. The method as recited in claim 10, further comprising forming the dispersion member as a ring located in a housing mounted along an exterior of the base pipe.

17. The method as recited in claim 10, further comprising forming the dispersion member as part of a housing mounted along an exterior of the base pipe.

18. A system, comprising:

a base pipe having an interior flow passage for an injection fluid and a nozzle positioned within a lateral port extending through a wall of the base pipe providing an exit for the injection fluid;

a housing positioned over the lateral port to create a chamber into which the injection fluid flows after exiting the lateral port; and a dispersion member having a plurality of teeth separated by spaces disposed in the chamber downstream of the lateral port and in a flow path of the injection fluid after the injection fluid exits the internal flow passage, the plurality of teeth separated by spaces dispersing the injection fluid, wherein the injection fluid is forced by the dispersion member to move longitudinally through the spaces between the plurality of teeth as the injection fluid flows through the chamber.

19. The system of claim 18, wherein the plurality of teeth of the dispersion member extend inwardly toward the base pipe.

20. The system of claim 18, wherein the chamber is shaped to direct the injection fluid to an interior of a filter medium after the injection fluid passes through the dispersion member, the filter medium being disposed about the base pipe.

21. The system of claim 2, wherein the plurality of teeth surrounds the nozzle.

22. The system of claim 19, wherein the dispersion member comprises a mounting structure mounted to the housing such that the plurality of teeth surrounds the lateral port.

* * * * *